United States Patent [19]

Smith

[11] Patent Number: 4,493,424

[45] Date of Patent: Jan. 15, 1985

[54] FOLDABLE DISPLAY STAND

[76] Inventor: Irving Smith, 2078 White Plains Rd., Bronx, N.Y. 10462

[21] Appl. No.: 310,078

[22] Filed: Oct. 9, 1981

[51] Int. Cl.[3] ..... A47F 5/11

[52] U.S. Cl. ..... 211/149; 108/111; 211/132; 428/542.8

[58] Field of Search ..... 211/73, 135, 149, 132; 206/44 R; 428/542.8; 312/259, 262; 108/115, 111, 134

[56] References Cited

U.S. PATENT DOCUMENTS

| | | | |
|---|---|---|---|
| 1,124,175 | 1/1915 | Sackett | 248/174 X |
| 1,947,746 | 2/1934 | Thomson | 248/174 X |
| 2,043,791 | 6/1936 | Barron | 248/174 X |
| 2,611,491 | 9/1952 | Lewis | 211/73 |
| 3,141,555 | 7/1964 | Funke et al. | 211/135 |
| 4,311,100 | 1/1982 | Gardner | 211/149 X |

*Primary Examiner*—Ramon S. Britts

*Assistant Examiner*—Robert W. Gibson, Jr.

*Attorney, Agent, or Firm*—Kirschstein, Kirschstein, Ottinger & Israel

[57] ABSTRACT

A foldable display stand, which can be constructed from a single sheet of material, has a back panel having a longitudinal slit therein, a pair of side panels each having first and second opposing edges, the first edge of each side panel hingedly connected to opposing side edges of said back panel such that each of said side panels can be positioned in substantially the same plane as said back panel; a front panel having first and second opposing sides hingedly attached to said second edge of said side panels, said front panel being in a plane substantially parallel to said back panel; a shelf hingedly attached to an edge of said front panel connecting said first and second sides of said front panel, said shelf extending from said front panel through said slit in said back panel, and biasing means for urging said side panels into substantially parallel planes.

14 Claims, 2 Drawing Figures

FOLDABLE DISPLAY STAND

DESCRIPTION OF THE INVENTION

There is a great demand for an inexpensive, portable and versatile display stand for merchandise in the retail industry which is sufficiently rigid and strong to support the weight of a substantial number of goods stacked therein. Such a stand should be easy to erect and to disassemble and should also be portable.

Figure 1:
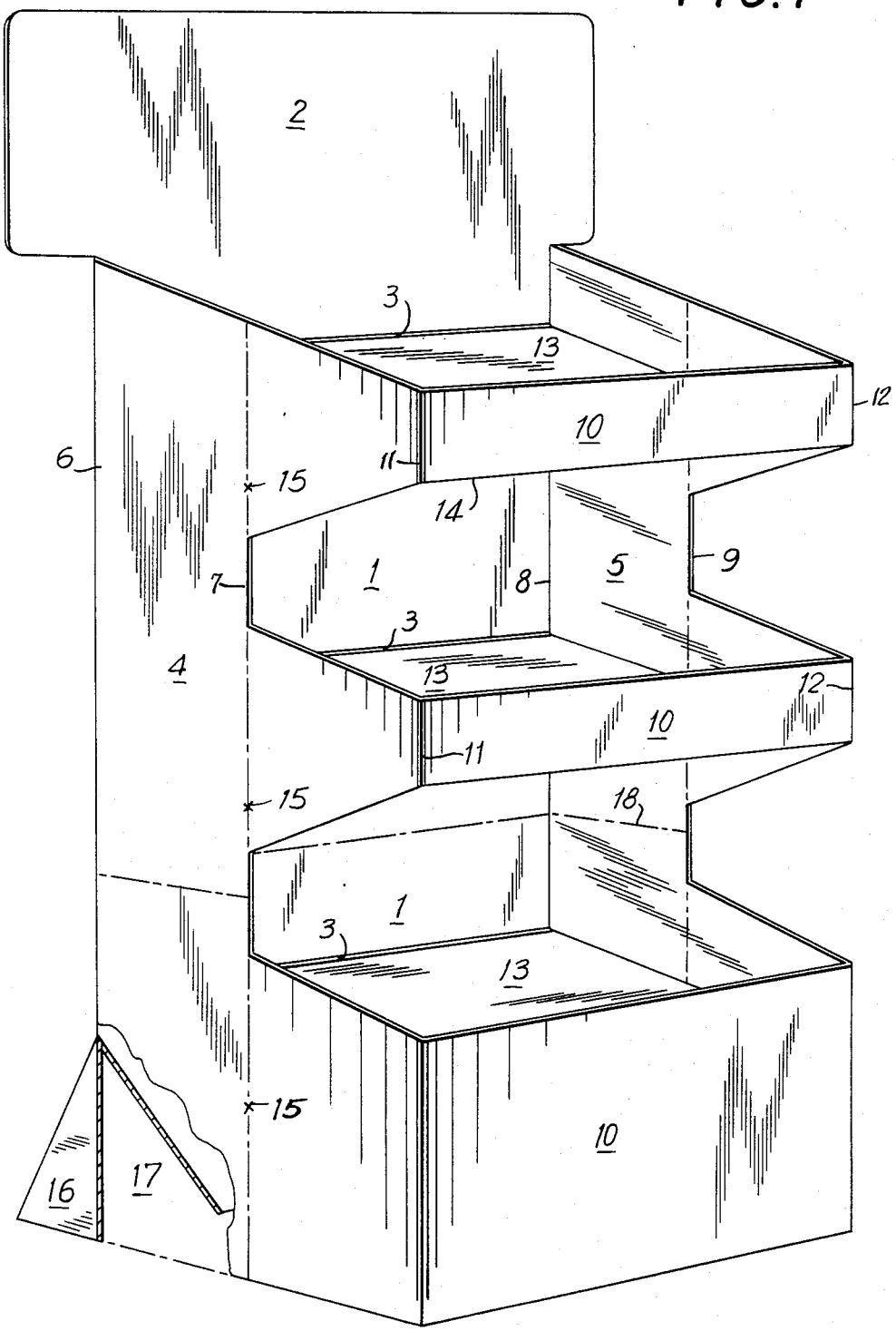
Figure 2:
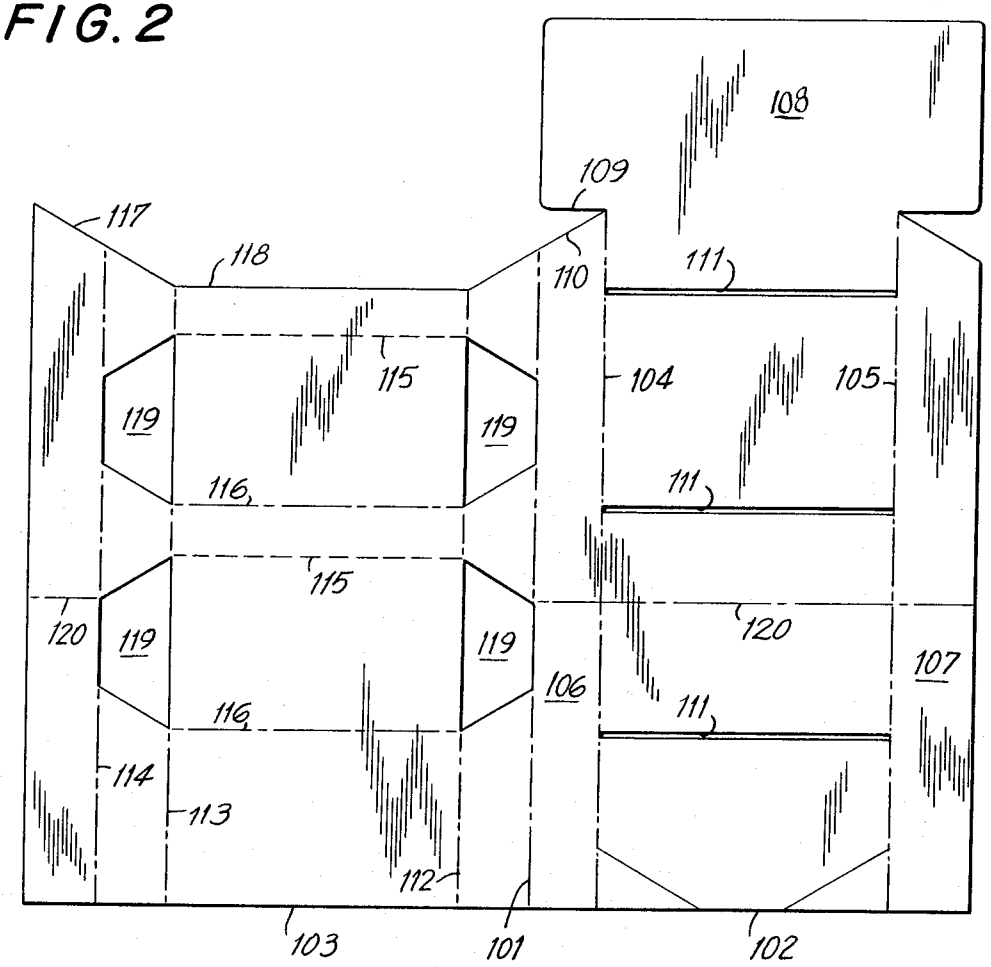

It is accordingly the object of this invention to provide a display stand which is easy to assemble and disassemble, which is rigid when assembled and which, if desired can be fabricated from a single sheet of material. This and other objects of the invention will become apparent from the following in which FIG. 1 is a plan view of a display stand of the present invention; and FIG. 2 is a plan view of a sheet which can be used to construct the stand of FIG. 1.

The display stand of the invention can be fabricated from any suitable material and is preferably made of cardboard. As can be seen in FIG. 1, the stand has a back panel 1 which, if desired, can have the uppermost portion thereof 2 elongated outwardly in order to provide a more eye catching area for advertising copy.

Back panel 1 is provided with one or more longitudinal slits 3 therein.

A pair of side panels 4,5 are provided, each of which has first and second opposing edges 6,7 and 8,9, respectively. The first edge 6 of side panel 4 is hingedly connected to one vertical edge of back panel 1 and the first edge 8 of side panel 5 is similarly hingedly connected to the other vertical edge of back panel 1. The hinge connections permit side panels 4,5 to be positioned in substantially the same plane as back panel 1, i.e., along side of it and to swing through about 90° to their position when the stand is erect.

The display stand has one or more front panels 10, each of which have a pair of opposed side edges 11,12. First edge 11 of front panel 10 is hingedly attached to second edge 7 of side panel 4 and the second edge 12 of front panel 10 is hingedly connected to second edge 9 of side panel 5. Note that front panel 10 is in a plane substantially parallel to back panel 1.

In a preferred embodiment, side panels 4,5 are hinged at about their horizontal midpoint and the half connected to front panel 10 has a trapezoidal shape, the larger of the parallel sides lying along the hinge line. This provides an attractive shape.

The display stand can have any number of shelves 13, as desired. Each shelf 13 is hingedly attached to an edge 14 of front panel 10 which connects edges 11 and 12 thereof. The shelf 13 extends from the hinged portion to and through the longitudinal slit 3 in back panel 1. Thus, each shelf 13 is supported on one side by being attached to front panel 10 and on the opposite end by resting on slit 3 while the side edges of shelf 13 are not supported but lean against side panels 4,5 which provides a measure of support. To maintain side panels 4,5 pressing against the shelves 13, suitable biasing means are provided. This can take the form of elastic which is stapled or otherwise secured to side panels 4,5. Preferably, staples 15 are located on the side panels 4,5 at the midpoint hinge line.

For added stability, a triangular section 16, one side of which is hingedly attached to the lower end of side panels 4,5 can be utilized.

To disassemble the display stand of the present invention, edge 7 of side panel 4 and edge 9 of side panel 5 are swung outwardly, overcomming the biasing means, until side panels 4,5 are in the same plane as back panel 1. This action causes front panel 10 to move toward and against back panel 1. As front panel 10 moves toward back panel 1, shelf 13 slides through slit 3 and since shelf 13 is hinged to front panel 10, shelf 13 can be swung against the back side of back panel 1. In the preferred embodiment shown in FIG. 1, the trapozidal half of each side panel 4,5 lies in the same plane as front panel 10 and against the other section of side panel 4,5. The triangular section 16 is swung, as side panels 4,5 are rotated, against back panel 1 which preferably has a correspondingly shaped removed portion 17 so that section 16 can lie in the same plane as back panel 1 between back panel 1 and side panels 4,5. As a result, the disassembled display stand is a very compact unit and can be fit into a small space for transportation and/or storage. The action of the biasing means can be overcome or neutralized by clamps or other similar apparatus, or, in the preferred embodiment, by folding the top half of the display stand onto the bottom half along a horizontal fold line 18.

The display stand is assembled by merely snaping it into its erect position. The top half is unfolded from its position against the bottom half. A slight force is exerted to urge side panels 4,5 toward front panel 10 whereupon the biasing means will cause the side panels 4,5 to move towards one another. Since front panel 10 is hingedly attached to side panels 4,5, front panel 10 will be moved away from back panel 1 as a result of the movement of side panels 4,5 caused by the biasing means, and will pull shelf 13 through the slit 3 into its display position.

One particular advantage of the display stand of the present invention is that it can be constructed from a single sheet of cardboard or the like material by making appropriate fold lines and scored lines therein. Such a sheet is shown in FIG. 2.

A sheet of cardboard or the like is divided in half by a vertical fold line 101 at about the mid point so as to realize first and second sheet sections 102 and 103. To provide advertising copy or display space, first section 102 can extend vertically beyond the top of second section 103. First section 102 is provided with a pair of vertical fold lines 104 and 105 which are spaced apart and define the back panel of the display stand between them. The area 106 between fold lines 101 and 104, on the one hand, and the area 107 between fold line 105 and the end of the sheet define one half of the side panels of the display stand. If the display space 108 extends beyond either or both of fold lines 104 and 105, a cut or score 109 is provided from the edge of section 102 to the respective fold lines 104, 105. Should it be desired to have an angled or sloped side panel, a second score 110 is provided from the edge of section 102 to fold lines 104 and/or 105 and forms with score 109 a notch therebetween.

A horizontal slit is provided extending from fold line 104 to fold line 105 for each shelf of the display stand. The shelves can be made to lie flat or at an angle by appropriately locating the slits 111.

The second section of the sheet is also provided with a pair of fold lines 112 and 113 which extend vertically.

The area between fold lines 112 and 113 forms the front panels and shelves of the display stand. In some embodiments, it may be desireable for fold line 112 and the section dividing fold line 101 to coinside. However, the distance between fold lines 112 and 101 in the preferred embodiment is about the same as the distance from fold line 101 to fold line 104. The distance from fold line 113 to the lateral edge of second section 103 is not critical and is preferably about the same as the distance between fold lines 104 and 112 and is provided with a vertical fold line 114 at about its midpoint.

A horizontal cut or score 115 extending from fold line 112 to fold line 113 is made in second section 103. Substantially parallel thereto and spaced apart therefrom, a horizontal fold line 116 is established. The lengths of fold lines 112 and 113 from horizontal fold line 116 to horizontal score line 115 is cut or scored. As a result, each shelf in the display stand is defined by two vertical scores along fold lines 112 and 113 interconnected by the horizontal score 115 and the horizontal fold 116. The front panels of the display stand are then defined by the horizontal score 115 and fold 116 between those portions of vertical fold lines 112 and 113 which have not been cut or scored.

In the preferred embodiment of the present invention, second score 110 is continued beyond the sheet section fold line 101 until it meets vertical fold line 112. A correspondingly angled score 117 is provided from the lateral edge of second section 103 to vertical fold line 113 and an interconnection score 118 is provided from fold line 112 to fold line 113 so as to join scores 110 and 117. One or more pairs of trapozidal shaped cut-outs 119 are established with their parallel sides lying on fold lines 101, 112, 113 and 114, the larger of which lie on fold lines 112 and 113. Extra stability can be provided to the display stand when assembled by angling fold lines 104 and 105 at an acute angle toward each other a short distance before the bottom of first section 102. To fold the display stand in half when it is being disassembled and stored, a horizontal fold 120 is provided from one lateral edge of the sheet to the other except in those areas of the trapozidal cut-outs 119 and the parts of second section 103 which form the display stand shelves. Fold line 120 is preferably disposed so that a portion of the advertising space 108 extends beyond the bottom of the stand when it is folded in half.

To form the display stand of FIG. 1 from the scored and folded sheet of figure two, it is only necessary to glue, staple or otherwise secure that portion of second section 103 between the lateral edge thereof and fold line 114 to the correspondingly shaped section of first section 102 which lies between the lateral edge thereof and fold line 105, and also fit the shelf edge defined by score 115 through slit 111. It will be appreciated that the depth of the shelves which is established by the length of the scores connecting horizontal fold 116 and score 115 will be greater than the width of the side panels of the stand.

I claim:

1. A foldable display stand comprising:

a back panel having a longitudinal slit therein;

a pair of side panels each having first and second opposing edges, the first edge of each side panel hingedly connected to opposing side edges of said back panel such that each of said side panels can be positioned in substantially the same plane as said pack panel;

a front panel having first and second opposing sides hingedly attached to said second edge of said side panels, said front panel being in a plane substantially parallel to said back panel;

a shelf hingedly attached to an edge of said front panel connecting said first and second sides of said front panel, said shelf extending from said front panel through said slit in said back panel, said shelf and slit being dimensioned such that the entire shelf can pass through said slit;

and biasing means for urging said side panels into substantially parallel planes.

2. The display stand of claim 1 wherein there is a plurality of said longitudinal slits, front panels, shelves and biasing means.

3. The display stand of claim 2 wherein all of said elements except for said biasing means are a part of a single scored and folded sheet.

4. The display stand of claim 3 wherein the biasing means is an elastic band.

5. The display stand of claim 4 wherein said side panels press against said shelves.

6. The display stand of claim 5 wherein each of said back and side panels are divided into top and bottom sections which are hingedly attached to each other along a common substantially horizontal plane.

7. The display stand of claim 6 wherein the uppermost portion of said back panel has an advertising copy area extending therefrom.

8. The display stand of claim 6 wherein spaced segments of said second edge of each of said side panels constitute the shorter parallel side of a plurality of trapazoids, the longer parallel side of which is at about the horizontal midpoint of said side panels and the other sides of which constitute segments, each of said spaced edges extending from said spaced segments, each of said spaced segments including a point of hinged attachment of said second edge and said front panel.

9. A sheet for assembly into a foldable display stand having a vertical fold at about the midpoint thereof so as to divide the sheet into first and second sections;

said first section having a pair of spaced vertical fold lines so as to define a back panel therebetween and a pair of side panels attached to said back panel;

a horizontal slit in said back panel;

said second section having a pair of spaced vertical fold lines so as to define a front member therebetween and a pair a side members attached to said front member;

a pair of spaced horizontal scores in said front member;

a horizontal fold line between said pair of spaced horizontal scores and spaced therefrom; and a pair of vertical scores extending along said pair of spaced vertical fold lines of said second section from one of said pair of spaced horizontal scores to said horizontal fold line.

10. The sheet of claim 9 having a plurality of said slits in said back panel and a plurality in said front members of pairs of spaced horizontal scores, horizontal fold lines and pair of vertical scores.

11. The sheet of claim 10 wherein each of said vertical scores along said vertical fold lines constitute the longer parallel side of a trapezoid cut-out, the shorter parallel side thereof is located on the fold line dividing the first and second sections or on the imaginary vertical midpoint line of the outermost side member.

12. The sheet of claim 11 having a horizontal fold line extending across said first section and said side members of said second section.

13. The sheet of claim 12 wherein the spaced vertical fold lines of said first section are angled and scored inwardly at about the bottom of said first section.

14. The sheet of claim 13 wherein an advertising copy area extends from the uppermost portion of said back panel.

* * * * *